US006320171B1

(12) United States Patent
Kim

(10) Patent No.: US 6,320,171 B1
(45) Date of Patent: Nov. 20, 2001

(54) MICROWAVE OVEN

(75) Inventor: Sun-ki Kim, Kyungki-do (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/649,201

(22) Filed: Aug. 28, 2000

(30) Foreign Application Priority Data

Nov. 16, 1999 (KR) ..... 99-50872

(51) Int. Cl.[7] ..... H05B 6/68

(52) U.S. Cl. ..... 219/715; 219/757; 219/760; 126/21 A

(58) Field of Search ..... 219/757, 760, 219/756, 715, 716, 681, 702, 717; 126/21 A

(56) References Cited

U.S. PATENT DOCUMENTS 3,576,417 * 4/1971 Tingley ..... 219/757
3,681,557 * 8/1972 Suzuki et al. ..... 219/757
4,175,246 * 11/1979 Feinberg et al. ..... 219/715
4,354,084 * 10/1982 Husslein et al. ..... 219/757
4,623,771 * 11/1986 Sakino ..... 219/757
5,212,360 * 5/1993 Carlson ..... 219/760

FOREIGN PATENT DOCUMENTS 0 686 814 * 12/1995 (EP) .
2 176 378 * 12/1986 (GB) ..... 219/757
3-196486 * 8/1991 (JP) .
4-87184 * 3/1992 (JP) .

* cited by examiner

*Primary Examiner*—Philip H. Leung
(74) *Attorney, Agent, or Firm*—Robert E. Bushnell, Esq.

(57) ABSTRACT

A microwave oven having a body casing forming a cooking chamber, an outer casing enclosing the body casing, and a magnetron for supplying the cooking chamber with microwaves is provided. The microwave oven includes a plurality of high-voltage transformers installed in series between the top of the body casing and the outer casing, each high-voltage transformer supplying the high voltage to the magnetron. With this configuration, the height for installing the high-voltage transformer is lowered, so the cooking chamber can be extended to a rear area of the control panel to thereby increase the size of the cooking chamber. The heat generated from the component chamber can be effectively discharged outside, and turns of a winding for the high-voltage transformer can be decreased, thereby reducing the cost of production.

20 Claims, 3 Drawing Sheets

MICROWAVE OVEN

CLAIM OF PRIORITY

This application makes reference to, incorporates the same herein, and claims all benefits accruing under 35 U.S.C. §119 from my application MICROWAVE OVEN filed with the Korean Industrial Property Office on Nov. 16, 1999 and there duly assigned Ser. No. 50872/1999.

BACKGROUND OF THE INVENTION

1. Field of the Invention

The present invention relates to a microwave oven including a component chamber having a magnetron and high voltage transformers, and more particularly, a microwave oven including the component chamber having high voltage transformers disposed in a space formed in the top of a cooking chamber.

2. Description of the Related Art

Installation of a wall-mounted microwave oven has been proposed for a gas range for functioning as a hood. Typically, the wall-mounted microwave oven includes a cooking chamber, a component chamber formed in a side portion of the wall-mounted oven, an inlet formed on the bottom of the wall-mounted oven, an outlet formed on a top potion of the wall-mounted oven, and a duct disposed in the side portion to couple the inlet to the outlet. Since the wall-mounted oven is mounted over the gas range, the air generated from and heated by the gas range is blown into the duct through the inlet and discharged outside of the wall-mounted microwave oven through the outlet.

For example, FIG. 1 shows a conventional microwave oven mounted over the gas range. The microwave oven includes a main body and a casing. The main body includes a cooking chamber, a control panel, and a component chamber. The casing enclosing the main body includes an upper casing 101 and a lower casing 103 assembled to the upper casing 101.

The lower casing 103 has a pair of suction ports 119 for drawing in heated air generated from a gas range located below the microwave oven. The upper casing 101 has a discharge port 117 discharging out the heated air drawn into a space between the upper casing and the main body through the suction ports 119. Below the discharge port 117 is installed a hood fan 121 for discharging out the heated air drawn from the suction ports 119 through the discharge port 117.

Between the upper casing 101 and the lower casing 103 is installed a body 105 having a cooking chamber 107. The space is formed between the upper casing 101 and the body 105. In the body 105 is installed a partition 118 having a shape of "⊐" with a space being formed between the body 105 and sidewalls of the cooking chamber 107. A second space formed between the upper casing 101 and the top of the body 105 is separated into two parts by an auxiliary partition 181. On the top area between the upper casing 101 and the body 105 is installed a grill member 123 along the horizontal direction of a door 111.

On the right sidewall of the cooking chamber 107 are formed a number of air inlet holes 108 which communicate with a space formed between the right sidewall of the cooking chamber 107 and the partition 118. On the top plate of the cooking chamber 107 are formed a number of air outlet holes 109 which communicate with the space formed between the upper casing 101 and the body 105. A tray 116 is provided within the cooking chamber 107. In the front of the cooking chamber 107 is installed the door 111 for opening and closing the cooking chamber 107. In the right area of the door 111 is installed a control panel 113 having a number of buttons for operating the microwave oven.

Beside the air inlet holes 108 formed on the right sidewall of the cooking chamber 107 is formed a shield bracket 189 having a L shape for shielding the air inlet holes 108. On the top plate of the cooking chamber 107 are formed a flange part 187 having a number of elongated holes 188. The flange part 187 located behind the control panel 113, and an isolating bracket 183 isolating the flange part 187 from the second space between the upper casing 110 and the top plate of the body 105.

In the microwave oven with this configuration, a variety of components are positioned in the space formed between the right sidewall of the cooking chamber 107 and the body casing 105 and located behind the control panel 113. That is, a high-voltage transformer 131, a low-voltage transformer 190, a high-voltage condenser 163 are installed on the bottom plate of the body 105 whereas a magnetron 153 is installed adjacent to the air inlet holes 108 of the cooking chamber 107. In addition, a fan 125 supported by a support bracket 185 is slantly positioned between the magnetron 153 and the back side of the body casing 105.

In the microwave oven, cooling of the components such as high-voltage transformer 131 and removal of fumes generated within the cooking chamber 107 during cooking are carried out by the following processes. Outdoor air is drawn in through the grill member 123 and guided into the bottom part of the space formed between the right sidewall of the cooking chamber 107 and the body casing 105 through the elongated holes 188 formed in the flange part 187. The air guided into the bottom part of the space between the right sidewall of the cooking chamber 107 and the body 105, cools the high-voltage condenser 163, the low-voltage transformer 190, and the high-voltage transformer 131 in sequence. Thereafter, the air is blown into the cooking chamber through the air inlet holes 108 by the fan 125 after cooling the magnetron 153.

A large part of the air blown by the fan 125 passes through the air inlet holes 108, the inside of the cooking chamber 107, and the air outlet holes 109 sequentially, and is then discharged outside through the grill member 123. The remaining of the air passes a space between the auxiliary partition 181 and the bracket 183 and is then discharged outside through the grill member 123.

The component chamber including a magnetron and a plurality of high voltage transformers is located in the side portion and adjacent to the duct through which the air containing fumes and smoke passes. If the duct is not sealed, the fumes and smoke may blow into the component chamber and damage the components. Moreover, since the components and the duct are located in the same side portion of the oven, the cooking chamber can not be enlarged. The size of the cooking chamber is relatively small in comparison with the whole size of the oven. Furthermore, a passage of outdoor air drawn from outside of the oven into the component chamber is too complicated to efficiently cool the components located in the component chamber. It is difficult to efficiently discharge the heat generated from the components, such as a high-voltage transformer, outside of the oven.

SUMMARY OF THE INVENTION

It is an object of the present invention to provide an improved microwave oven.

It is another object to provide a microwave oven providing a larger cooking chamber.

It is yet another object to provide a microwave oven able to efficiently discharge the heat generated from a high voltage transformer.

It is still another object to provide a microwave oven able to reduce height of high-voltage transformers in order to be disposed within a space between a casing and a top plate of a cooking chamber.

It is a further object to provide a microwave oven with a smaller size of high-voltage transformers.

It is also an object to provide a microwave oven able to improve the passage of air cooling.

These and other object may be achieved with a microwave oven constructed with a body having a cooking chamber, an outer casing enclosing the body casing, a magnetron supplying the cooking chamber with microwaves, and a plurality of high-voltage transformers supplying a driving voltage to the magnetron, the magnetron and the high-voltage transformers installed in series in a space formed between a top plate of the body and the outer casing. A cooling system controlling the temperature of the high-voltage transformer may be constructed with an inlet grill member installed to communicate with a side space formed between a side wall of the cooking chamber and the outer casing, draws outside air into the side space. A fan installed in the rear of the inlet grill member blows the air from the inlet grill member into the top space between a top plate of the body and the outer casing. An outlet grill member installed to communicate with the top space between the top pate of the body and the outer casing discharges the air blown from the cooking chamber outside of the microwave oven. A fan duct installed adjacent to the fan guides the air discharged from the fan into the top space between the top plate of the body and the outer casing. A guide duct installed in the top space and the top plate of the body guides the air discharged from the cooking chamber toward the outlet grill member.

The high-voltage transformers are disposed in the top space while the magnetron is disposed in the side space. The height of the high-voltage transformers is reduced to that of the top space in order to be placed within the top space. Two or more high-voltage transformers reduced in size can be used for a magnetron in consideration of the height of the top space. Primary windings of the high-voltage transformers coupled to a power source are connected in series, and second windings of the high-voltage transformers coupled to the magnetron are connected in series.

BRIEF DESCRIPTION OF THE DRAWINGS

A more complete appreciation of the invention, and may of the attendant advantages, thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
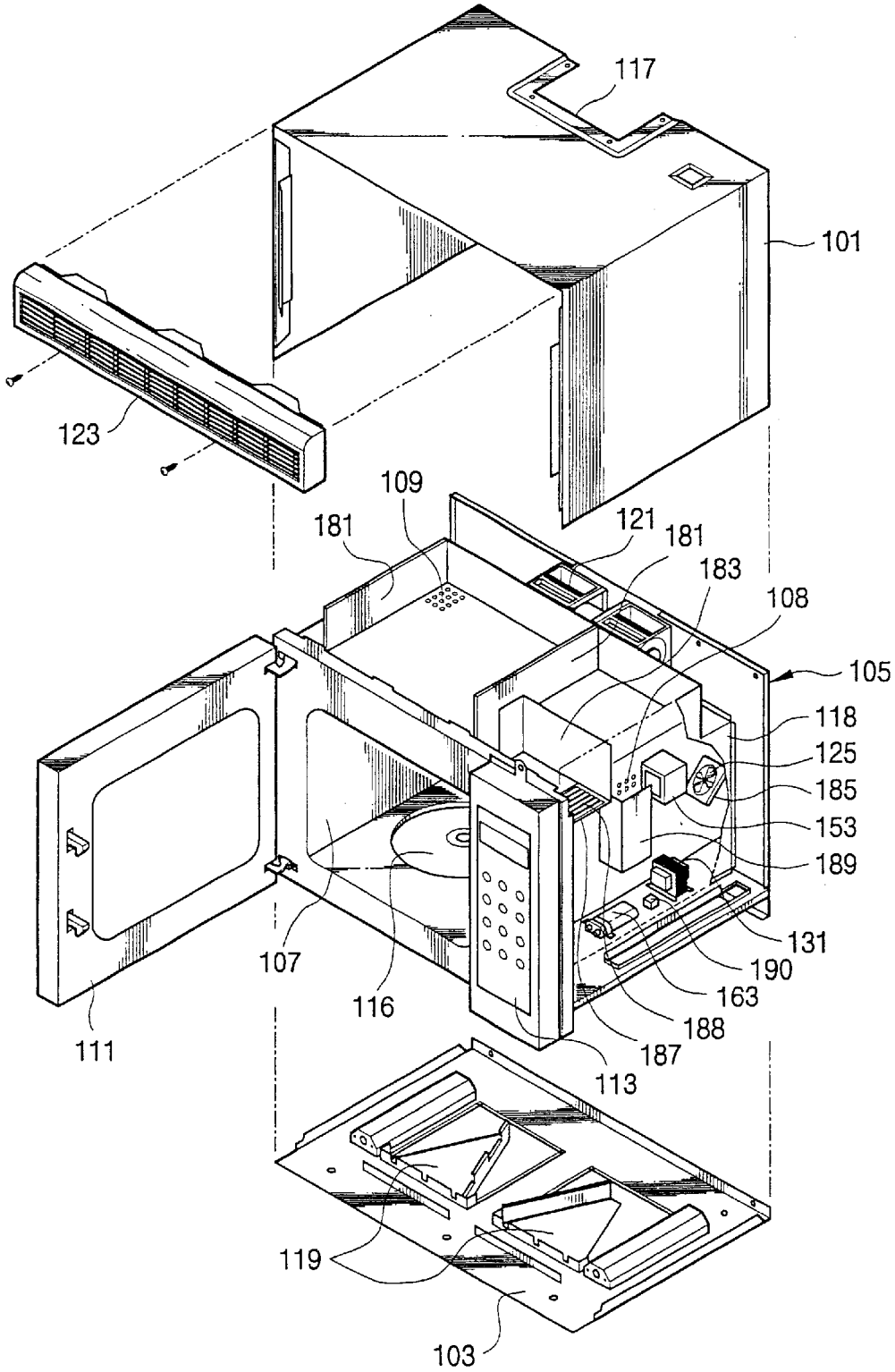
FIG. 1 (Prior Art)
FIG. 1 is an exploded perspective view of a conventional microwave oven
Figure 2:
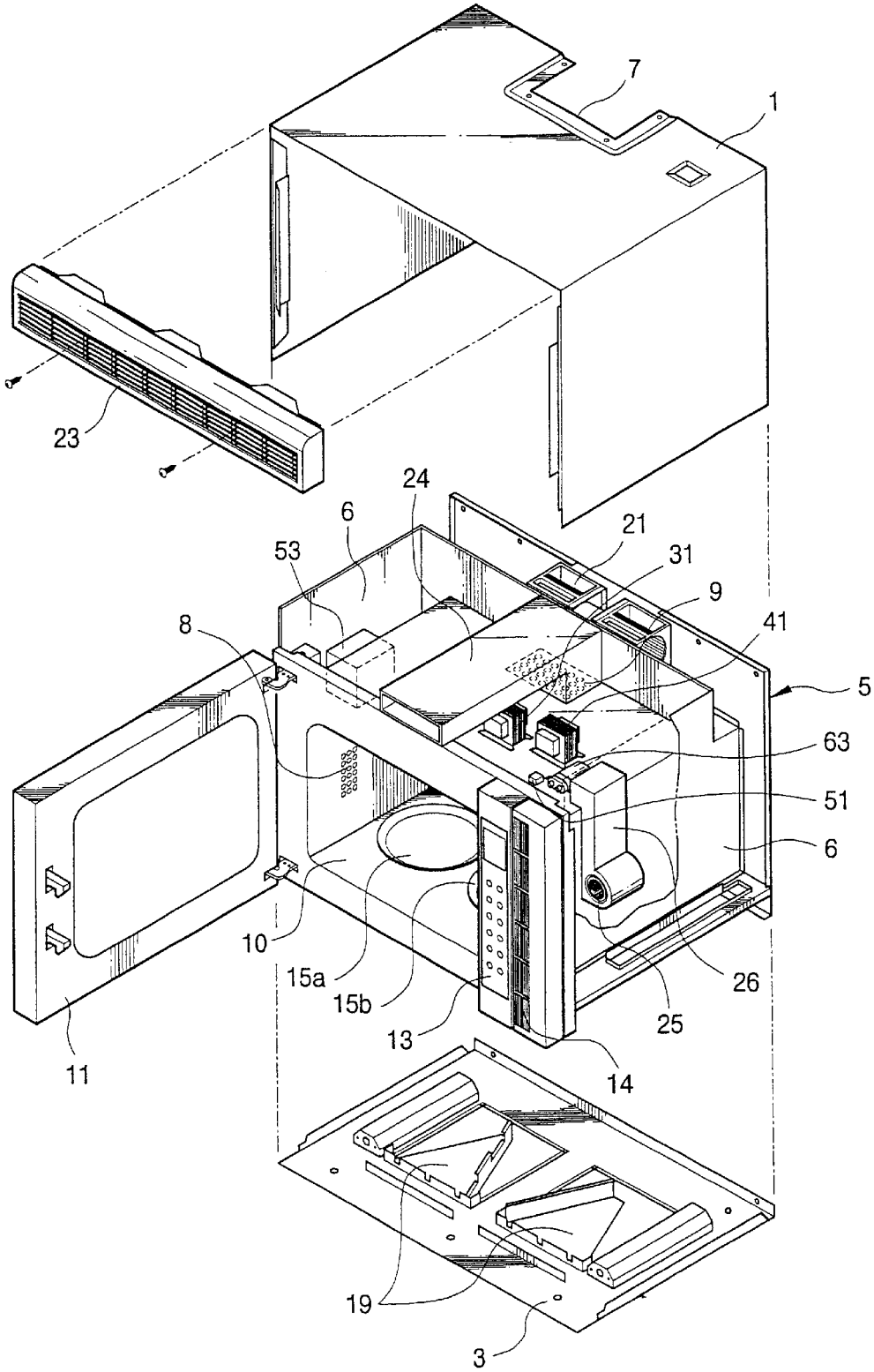
FIG. 2 is an exploded perspective view of a microwave oven constructed according to the principle of the present invention.

Referring to FIG. 2, a microwave oven includes a body 5, an upper casing 1 enclosing the body 5, and a lower casing 3 assembled to the upper casing 1 and the body 5. The lower casing 3 has a pair of suction ports 19 for drawing heated air generated from a gas range into the microwave oven. The upper casing 1 has a discharge port 7 for discharging out the heated air drawn through the suction ports 19. Below the discharge port 7 is installed a hood fan 21 for discharging the heated air out of the microwave oven through the discharge port 7. Between the upper casing 1 and the lower casing 3 is installed a body 5 having a cooking chamber 10. In the body casing 5 is installed a partition 6 having the shape of "⊐". The body 5 is spaced-apart from the upper casing 1 by a top portion of the partition to thereby form a first space therebetween. On the top area between the upper casing 1 and the body 5 is installed an outlet grill member 23 along the horizontal direction of the door 11 in a closed state.

On the left sidewall of the cooking chamber 10 are formed a number of air holes 8 which communicate with a second space formed between the left sidewall of the cooking chamber 10 and the partition 6. On the top plate of the cooking chamber 10 are formed a number of air outlet holes 9 which communicate with the first space formed between the upper casing 1 and the top of the body 5. A guide duct 24 is disposed over the air outlet holes 9 toward the outlet grill member 23 to guide the air blown out from the air outlet 9 to outlet grill member 23. A pair of trays 15*a* and 15*b* are provided within the cooking chamber 10.

In the front of the cooking chamber 10 is installed the door 11 for opening and closing the cooking chamber 10. On the right of the door 11 are installed an inlet grill member 14 and a control panel 13 having a number of buttons for operating the microwave oven. The inlet grill member 14 is positioned in the front of a third space formed between the right sidewall of the cooking chamber 10 and the partition 6. In the space formed between the right sidewall of the cooking chamber 10 and the partition 6 and in the rear portion of the inlet grill member 14 are installed a fan 25 and a fan duct 26. The fan duct 26 is bent toward the first space formed between the upper casing 1 and the top plate of the body 5. The heated air blown in through suction port 19 of lower casing 3 is guided through a fourth space formed between the partition 6 and sidewalls of the upper casing 1 and through a fifth space formed between a back plate of body 5 and the back portion of the partition 6.

In the microwave oven with this configuration, a variety of components are positioned in the first space between the upper casing 1 and the top plate of the body casing or in the second space between the left wall of the cooking chamber 10 and the partition 6. That is, a pair of high-voltage transformers 31 and 41, a low-voltage transformer 51, and a high-voltage condenser 63 are installed in the first space between the upper casing and the top of the body 5 and in the front of the fan duct 26, and a magnetron 53 is installed either in the second space between the left sidewall of the cooking chamber 10 and the partition 6 or in the first space between the upper casing 1 and the top plate of the body 5. A number of air inlet holes 8 are formed on the left sidewall of the cooking chamber 10.

Figure 3:
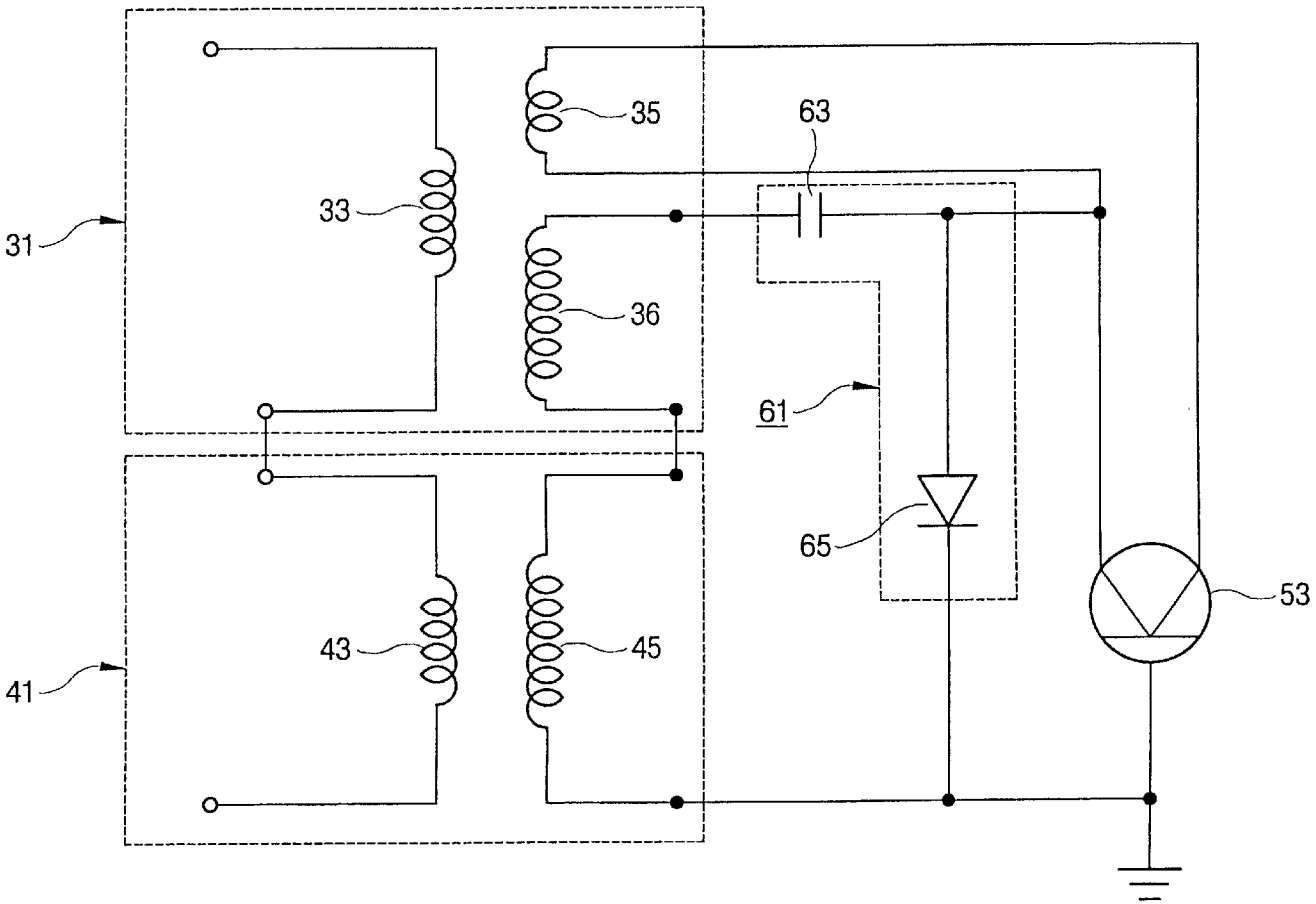
FIG. 3 is a circuit diagram of a high-voltage transformer and a rectifier constructed according to the principle of the present invention.

FIG. 3 shows a circuit diagram for connections between the pair of high-voltage transformers 31 and 41 and between the high-voltage condenser 63 and the magnetron 53. Primary windings 33 and 43 connected to an external power source are coupled in series. Secondary windings 35, 36, and 45 of the pair of high-voltage transformers 31 and 41 are connected in series. The high-voltage transformer 31 has a double-coiled secondary structure in which the two secondary windings 35 and 36 are connected in series. One of the secondary winding 35 induces a heating voltage of the magnetron 53 while the other one of the secondary winding 36 induces a terminal voltage of the magnetron 53. The high-voltage transformer 41 has a single secondary winding 45. The secondary winding 45 induces a terminal voltage of the magnetron 53. Here, it is desirable that the primary windings 33 and 43 and the secondary windings 36 and 45 have the same number of windings so that voltage supplied from the external power source can be equally divided into each of the high-voltage transformers 31 and 41, and the same terminal voltages can be induced at the magnetron 53.

A rectifier 61 including the high-voltage condenser 63 and a high-voltage diode 65 is connected to the secondary winding 36 of the high-voltage transformer 31 and the secondary winding 45 of the high-voltage transformer 41. The voltage of 2,200 ÛD induced from the high-voltage transformers 31 and 41 is rectified by the rectifier 61 and increased to 4,000 ÛD or more and is then is applied between cathode and anode of the magnetron 53.

In the microwave oven according to the principle of the present invention, cooling of the components such as high-voltage transformers and removal of fumes generated within the cooking chamber during cooking are carried out by the following processes. Outdoor air is drawn in through the inlet grill member 14 by the fan 25 and guided into the first space between the upper casing 1 and the top plate of the body 5 through the fan duct 26. The air guided into the first space between the upper casing 1 and the top plate of the body casing 5 passes through the high-voltage transformers 31 and 41, the high-voltage condenser 63, the low-voltage transformer 51, and the magnetron 53 in sequence. Thereafter, the air of a top plate is drawn inside of the cooking chamber 10 through air inlet holes 8 formed on a side wall of a top plate of the cooking chamber 10. The air drawn inside of the cooking chamber 10 is blown into guide duct 24 located in a portion of the first space between the upper casing 1 and the top plate of the body 5 through the air outlet holes 9 and is then discharged outside of the microwave oven through the guide duct 24 and the outlet grill member 23. With this configuration, the microwave oven according to the present invention can obtain an enlarged cooking chamber 10. The volume of the cooking chamber 10 is extended to the rear area of the control panel 13. Further, since the secondary windings 35 and 36, and 45 of the high-voltage transformers 31 and 41 induce the terminal voltages of 1,100 ÛD of the magnetron 53, respectively, the turns of winding is decreased compared with the number of the secondary windings for the conventional high-voltage transformer, thereby reducing the volume of each high-voltage transformer. Accordingly, the height of the high-voltage transformers becomes relatively reduced when compared with the conventional transformer, thereby enlarging the cooking chamber upwardly and reducing resistance applied to the air.

The embodiment according to the principle of the present invention described above discloses that voltage for driving the magnetron 53 is provided by means of the pair of high-voltage transformers 31 and 41. However, considering that the space created on the top of the cooking chamber is comparatively wide, three high-voltage transformers may be installed. In this case, the height required for installing the high-voltage transformer is greatly reduced.

The above-described embodiment discloses that the inlet grill member 14 is installed in the right side of the control panel 13, that a fan 25 is installed in the third space between the right sidewall of the cooking chamber 10 and the partition 6 and behind the inlet grill member 14, and that the air inlet holes 8 are formed on the left sidewall of the cooking chamber 10. However, the inlet grill member 14 can be installed in the left side of the door 11. A fan can be installed in the second space between the left sidewall of the cooking chamber 10 and the partition 6 and behind the inlet grill member 14 while the air inlet holes 8 are formed on the right sidewall of the cooking chamber 10. According to the principle of the present invention, outdoor air drawn by the fan 25 is circulated through the first space between the upper casing 1 and the top plate of the body casing 5, the second space between the side walls of the cooking chamber 10 and the partition 6, and the inside of the cooking chamber 10 in sequence. However, an extra outlet grill member can be provided at the front of the second space between the left sidewall of the cooking chamber 10 and the partition 6 and at opposite side to the inlet grill member 14 so that the outdoor air is circulated only through the first space between the upper casing 1 and the top plate of the body 5 and the second and third spaces between the side walls of the cooking chamber 10 and the partition 6. Although, the embodiment only discloses the microwave oven having the partition 6, no partition can be used in the microwave oven.

As stated above, according to the principle of the present invention, the first space formed on the top plate of the cooking chamber is used as the component chamber, and voltage for driving the magnetron is supplied by means of the pair of high-voltage transformers. With this configuration, a cooking chamber is extended to the rear area of the control panel, and the height of the high-voltage transformers is reduced to that of the first space. In consequence, not only the cooking chamber is enlarged, but the heat generated from the components can also be efficiently discharged outside. Further, since windings for the high-voltage transformers having a narrower diameter are sufficient to efficiently discharge the heat, cost of production will be reduced.

Although the present invention has been described in connection with an embodiment thereof, it will be appreciated by those skilled in the art that additions, modifications, substitutions and deletions not specifically described may be made without departing from the spirit and scope of the invention as defined in the appended claims.

What is claimed is:

1. A microwave oven, comprising:

a body having an interior cooking chamber and a top plate forming a ceiling of said cooking chamber, having a first side plate and a second side plate both joined by said top plate and forming opposite sides of said cooking chamber;

an outer casing spaced apart from said top plate and said first and second side plates of said body, said outer casing enclosing said body, said outer casing defining a top space formed between said outer casing and said top plate of said body, a first side space formed between said outer casing and said first side plate of said body, and a second side space formed between said outer casing and said second side plate of said body;

a magnetron supplying said cooking chamber with microwave energy, disposed within said second space; and a plurality of high-voltage transformers installed in said top space, said high-voltage transformers being coupled to said magnetron to supply a driving voltage, said high-voltage transformers connected in series and being connectable between two terminals of an external power source.

2. The microwave oven of claim 1, further comprising primary windings of said high-voltage transformers connected in series, said primary windings each having a first terminal and a second terminal, each first terminal of said primary windings being connectable to respective two terminals of an external power source, each second terminal of said primary winding coupled to each other without being connected to a ground terminal.

3. The microwave oven of claim 2, further comprising secondary windings of said high-voltage transformers connected in series, said secondary winding each having a third terminal and a fourth terminal, each third terminal of said secondary windings connected to said magnetron, each fourth terminal of said secondary windings connected to each other.

4. The microwave oven of claim 1, further comprising an inlet grill installed across a front of said oven between said first side plate of said body and said outer casing to communicate with said first side space, providing an air passage for outside air to be drawn into said first space, said top space, and said second space.

5. The microwave oven of claim 4, further comprising a fan installed in a rear portion of the inlet grill, disposed in said first side space to force the outside air drawn from said inlet grill to flow into said first space, said top space, and said second side space in sequence.

6. The microwave oven of claim 5, further comprising a fan duct disposed adjacent to said fan and along said first side space and said top space to guide the air from said first space into said top space.

7. The microwave oven of claim 6, further comprising:

a first aperture formed on said second side plate to allow the air drawn in said second space to flow into said cooking chamber;

a second aperture formed on said top plate to allow the air drawn into said cooking chamber to flow into said top space;

an outlet grill installed across said front of said oven between said top plate of aid body and said outer casing to communicate with said second aperture and allowing the air drawn into said cooking chamber to be discharged from said cooking chamber outside of said microwave oven.

8. The microwave oven of claim 7, further comprising a guide duct installed in said top space connecting said second aperture of said cooking chamber to said outlet grill, and guiding the air discharged rom said cooking chamber toward said outlet grill.

9. A microwave oven, comprising:

a body having a cooking chamber, having a top plate forming a ceiling of said cooking chamber, and having a first plate and a second side plate joined to said first side plate by said top plate;

an outer casing spaced apart from said top plate and said first and second side plates, enclosing said body casing, defining a top space formed between said outer casing and said top plate, a first side space formed between said outer casing and said first side plate, and a second side space formed between said outer casing and second side plate, an inlet installed on a front and side portion of said oven between said first side plate and said outer casing to communicate with said first side space providing an air passage for outside air to be drawn into said first side space, said top space, and said second side space in sequence;

a first aperture formed on said second side plate to allow the air drawn into said second side space to flow into said cooking chamber;

a second aperture formed on said top plate to allow the air drawn into said cooking chamber to flow into said top space;

a plurality of high-voltage transformers mounted on said top plate of said body within said top space; and an outlet installed across a front and top portion of said oven between said top plate and said outer casing and connected to said second aperture of said top plate outside of said microwave oven, wherein the air drawn from said inlet is blown into said cooking chamber through said first side plate, said top space, and said second side space, and discharged from the cooking chamber through said outlet.

10. The microwave oven of claim 9, further comprising a fan mounted in a rear side of said inlet within said first side space, blowing air drawn through said inlet into said first side space and said top space.

11. The microwave oven of claim 10, further comprising a fan duct installed adjacent to said fan, guiding the air drawn into said first side space to flow into said top space.

12. The microwave oven of claim 9, further comprising a guide duct installed in said top plate of said body within said top space, guiding the air discharged from said cooking chamber toward said outlet.

13. The microwave oven of claim 9, further comprising a magnetron connected to said high-voltage transformers and mounted on said second side space.

14. The microwave oven of claim 13, with said magnetron disposed within said second side space opposite to said first side space about said cooking chamber.

15. The microwave oven of claim 9, with said high-voltage transformers comprising primary windings each having a first terminal and, a second terminal, each first terminal of said primary windings being connectable to respective terminals of an external power source, each second terminal of said primary windings coupled to each other.

16. The microwave oven of claim 15, with said high-voltage transformers comprising secondary windings each having a third terminal and a fourth terminal, each third terminal of said secondary windings coupled to magnetron, each fourth terminal of said secondary windings coupled to each other.

17. A microwave oven, comprising:

a body casing having a cooking chamber, having a top plate forming a ceiling of said cooking chamber, and having a first side plate and a second side plate both forming sides of said cooking chamber;

an outer casing enclosing said body casing and spaced-apart from said top, first side, and second side plates of said body, said outer casing defining a top space, a first side space, and a second side space with said top plate and first and second side plates, respectively;

at least two high-voltage transformers disposed in said top space said transformers each including a primary winding having a first terminal and a second terminal, each first terminal of said primary windings being connectable to an external power source, each second terminal of said primary windings coupled to each other, said transformer each including a secondary winding having a third terminal and a fourth terminal, each third terminal coupled to a magnetron while each fourth terminal is coupled to each other without coupling to a ground terminal; and an inlet disposed between said first side plate and said outer casing to allow external air to be drawn into said first side space and to be blown into said cooking chamber through said top space and said second side space in sequence.

18. The microwave oven of claim 17, further comprising an outlet disposed between said outer casing and said top plate to communicate with an aperture formed on said top plate and to discharged the air blown out from said cooking chamber outside of said microwave oven.

19. The microwave oven of claim 17, further comprising said magnetron connected to said high-voltage transformers and mounted on said second side space.

20. The microwave oven of claim 19, further comprising a fan mounted in a rear side of said inlet and disposed in said second side space, said fan forcing the air to flow through said first side space, said top space, said second side space, and said cooking chamber sequentially.

* * * * *